US005637064A

United States Patent [19]

Olson et al.

[11] Patent Number: 5,637,064

[45] Date of Patent: Jun. 10, 1997

[54] ADJUSTABLE DUMBBELL

[75] Inventors: Gregory S. Olson; Carl K. Towley, III, both of Owatonna, Minn.

[73] Assignee: Intellbell Ventures, Monterey, Calif.

[21] Appl. No.: 542,659

[22] Filed: Oct. 13, 1995

Related U.S. Application Data

[63] Continuation of Ser. No. 13,785, Feb. 5, 1993, abandoned.

[51] Int. Cl.[6] ..... A63B 21/075

[52] U.S. Cl. ..... 482/108; 482/107

[58] Field of Search ..... 482/93, 94, 105–109, 482/908

[56] References Cited

U.S. PATENT DOCUMENTS

| | | | |
|---|---|---|---|
| D. 244,628 | 6/1977 | Wright | D21/197 |
| D. 307,168 | 4/1990 | Vodhanel | D21/197 |
| D. 315,003 | 2/1991 | Huang | D21/197 |
| D. 321,230 | 10/1991 | Leonesio | D21/197 |
| D. 359,778 | 6/1995 | Towley, III | D21/197 |
| 1,422,888 | 7/1922 | Reeves et al. | 482/108 X |
| 1,672,944 | 6/1928 | Jowett | 482/108 |
| 1,917,566 | 7/1933 | Wood . | |
| 3,758,109 | 9/1973 | Bender . | |
| 4,029,312 | 6/1977 | Wright | 482/108 |
| 4,076,236 | 2/1978 | Ionel | 482/108 |
| 4,529,198 | 7/1985 | Hettick, Jr. | 482/107 X |
| 4,566,690 | 1/1986 | Schook . | |
| 4,575,074 | 3/1986 | Damratoski | 482/93 |
| 4,627,618 | 12/1986 | Schwartz | 482/108 |
| 4,651,988 | 3/1987 | Sobel | 482/93 X |
| 4,743,017 | 5/1988 | Jaeger . | |
| 4,768,780 | 9/1988 | Hayes | 482/106 X |
| 4,822,034 | 4/1989 | Shields . | |
| 4,880,229 | 11/1989 | Broussard . | |
| 4,900,016 | 2/1990 | Caruthers . | |
| 4,913,422 | 4/1990 | Elmore et al. . | |
| 4,948,123 | 8/1990 | Schook . | |
| 5,040,787 | 8/1991 | Brotman | 482/106 |
| 5,123,885 | 6/1992 | Shields | 482/106 |
| 5,131,898 | 7/1992 | Panagos | 482/108 |

FOREIGN PATENT DOCUMENTS

| | | | |
|---|---|---|---|
| 637365 | 4/1928 | France . | |
| 2452296 | 10/1980 | France . | |
| 384485 | 11/1964 | Switzerland . | |
| 1367987 | 1/1988 | U.S.S.R. | 482/108 |
| 1659073 | 6/1991 | U.S.S.R. | 482/108 |
| 1687271 | 10/1991 | U.S.S.R. | 482/107 |

OTHER PUBLICATIONS

"Physical Conditioning Equipment 86/87 Catalog", Universal Gym Equipment, Inc., pp. 46 and 47, copyright 1985.

*Primary Examiner*—Richard J. Apley
*Assistant Examiner*—John Mulcahy
*Attorney, Agent, or Firm*—John W. Bunch

[57] ABSTRACT

An adjustable dumbbell (10) includes a central handle (22) which can be selectively connected to one or more outer weights (24) by means of a selector pin (26). The outer weights (24) are arranged in a nested symmetrical stack which provides for a compact construction and storage of the unused weights at the same time. The adjustable dumbbell (10) is also incrementally adjustable, and may be used either in conjunction with or as a substitute for a conventional weight stack in an exercise machine.

10 Claims, 3 Drawing Sheets

ADJUSTABLE DUMBBELL

This application is a continuation of application Ser. No. 08/013,785, filed Feb. 5, 1993, abandoned.

TECHNICAL FIELD

The present invention relates generally to exercise equipment. More particularly, this invention pertains to an adjustable barbell or dumbbell of improved, compact construction.

BACKGROUND ART

Modern dumbbells have a long and interesting history. The earliest record of a dumbbell was the stone "haltere" used by the ancient Greeks and Romans to train their long jumpers. They were carried and dropped at lift off, and it was thought that the sudden release of the haltere resulted in the athlete jumping a greater distance.

During the 1700's and 1800's the wooden Indian club (pin) was popular as a gentlemen's physical culture device. These clubs were available in different weights and like the modern fixed weight dumbbell, were complete with a rack for storage. The heaviest Indian club was approximately thirty-five pounds. Considering that the athlete always grasped the club at its end, the use of a thirty-five pound pin was quite a demonstration of fore-arm strength.

The advent of the modern strongman in the late 1800's saw the development of the kettle bell. Like the Indian club, this bell forced the athlete to grasp an unbalanced weight resembling a bowling ball with a handle. Considerable skill, balance and strength was required to lift a kettle bell, the heaviest of which was in the 200–300 pound range.

Early balanced iron dumbbells became available after the turn of the century, with adjustable dumbbells being introduced by Milo Stanborn just before World War II.

Today, dumbbells are generally recognized as the most efficient of strength training devices. They allow extreme flexibility in patterns of movement and permit the athlete to perform a real world training regimen unlike, for example, bungee cord exercises. Therapists like to utilize dumbbells because they reflect everyday movements and their flexibility allows the patient to train around joint and muscle trauma. Athletes that train with dumbbells enjoy productive gains not available with other training modalities because they require balance and involve synergistic muscle groups to contract during the lift. The necessity to balance the dumbbells and coordinate movement of each hand stress the muscular and nervous system unlike any machine exercise. With machines, a portion of the athlete's musculature can actually relax due to the absence of fully balanced coordination; i.e., one side can push harder than the other.

There are two basic forms of dumbbells: fixed or "pro-style", and adjustable dumbbells. Fixed dumbbells are individually compact, but are typically sold in sets which must be stored on a rack that is bulky and cumbersome. Adjustable dumbbells have historically incorporated plates and locking collars secured to the ends of an extended handle.

Adjustable dumbbells are the most space and cost efficient exercise equipment, however, they are not without some drawbacks. One drawback is the time it takes to change or adjust both dumbbells. Removing and replacing the locking collars and plates is time consuming, and can be a potential safety hazard if the collars are not securely tightened. Another drawback is that it is difficult to perform a "kickup" due to the protruding end of the handle. Some exercises such as bench presses, inclines and shoulder work typically begin and end with the dumbbells resting on the knees of the athlete, however, this can be unwieldy and painful if the ends of the dumbbells are not relatively flat.

Various adjustable dumbbells have been developed heretofore. U.S. Pat. Nos. 4,948,123 and 4,566,690 to Schook, 4,913,422 to Elmore et al, 4,900,016 to Caruthers, 4,880,229 to Broussard, and 4,743,017 to Jaeger are representative of the prior art in this regard. Each of these references, however, addresses only certain aspects of an adjustable dumbbell, such as releasability, interlocking of the weights, etc.

There is still a need for an adjustable dumbbell of improved construction which is not only compact in size, but also easily and securely adjustable and comfortable to use without the clutter of loose weights.

SUMMARY OF INVENTION

The present invention comprises an improved dumbbell which overcomes the foregoing and other difficulties associated with the prior art. In accordance with the invention, there is provided a unique adjustable dumbbell which incorporates a nested weight arrangement. The adjustable dumbbell herein generally comprises a handle portion, a weight portion including a plurality of weights and means for selectively connecting the handle portion to the desired number of weights therein. The other weights remain together in a stacked or nested arrangement. The adjustable dumbbell herein can also be adjusted for incremental weights, and may also be adjusted to provide offset leverage for even more effective training.

BRIEF DESCRIPTION OF DRAWING

A better understanding of the invention can be had by reference to the following Detailed Description in conjunction with the accompanying Drawing, wherein.

DETAILED DESCRIPTION

Figure 1:
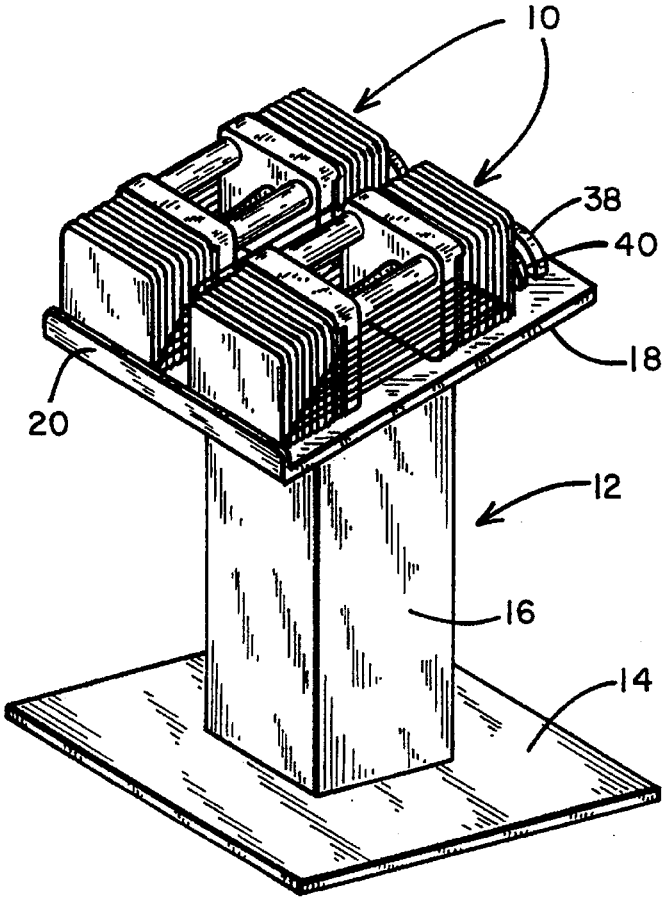
FIG. 1 is a perspective view of the adjustable dumbbell of the invention, shown on a stand.

Referring now to the Drawing, wherein like reference numerals designate like or corresponding elements throughout the views, and particularly referring to FIG. 1, there is shown a pair of adjustable dumbbells 10 incorporating the invention. The dumbbells 10 are shown on a stand 12 including a base 14, column 16 and inclined top tray 18. The upper surface of tray 18 is preferably coated or lined with an elastomeric material for skid resistance and noise reduction. A lip 20 is provided at the lower edge of tray 18 to prevent the adjustable dumbbells 10 from slipping off the stand 12. The stand 12 is preferably formed of sheet metal, with the top tray 18 tilted and elevated for convenient access by an athlete. As will be explained more fully hereinafter, the adjustable dumbbells 10 incorporate a unique nested handle and weight arrangement for more compact construction.

Figure 3:
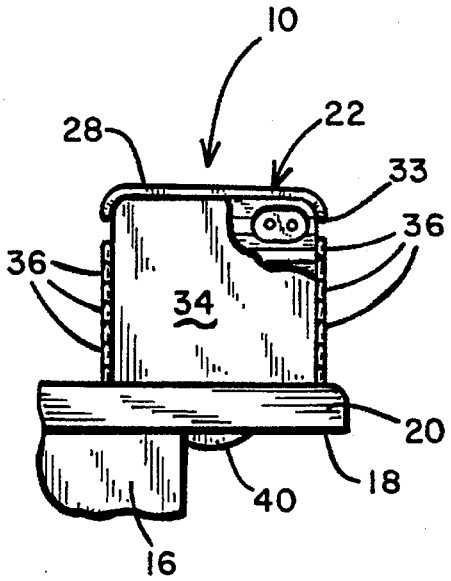
FIG. 3 is an end view thereof.
Figure 2:
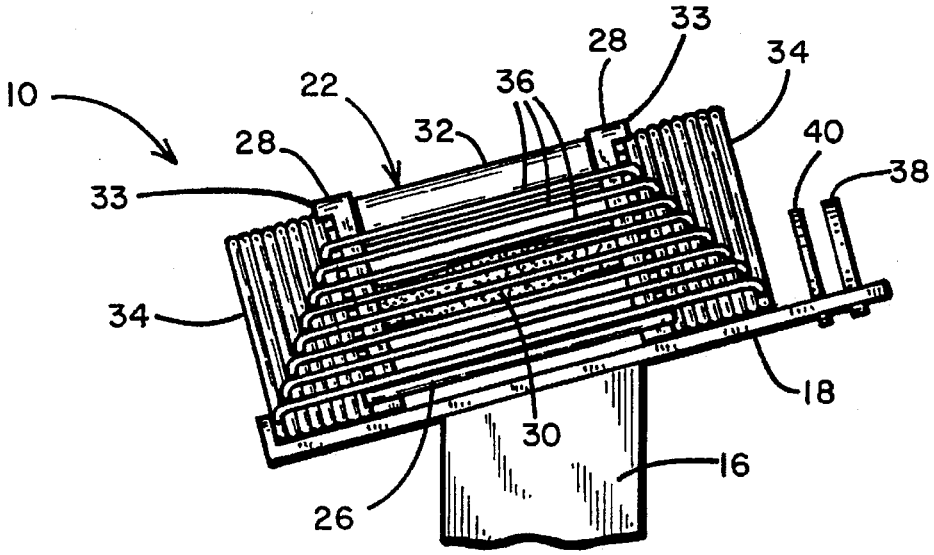
FIG. 2 is a side view of the adjustable dumbbell herein.
Figure 4:
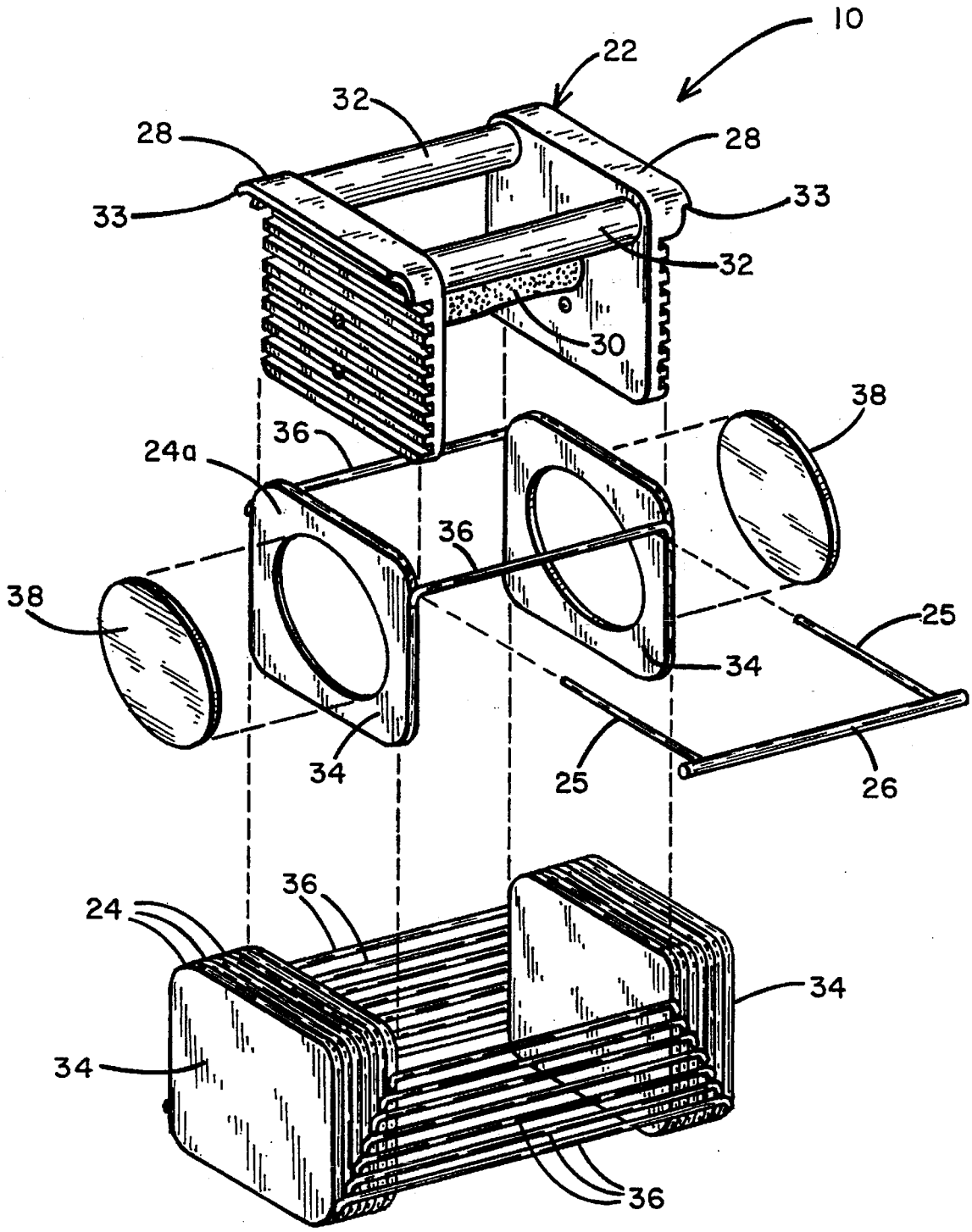
FIG. 4 is an exploded perspective view thereof.

Referring to FIGS. 2–4, the adjustable dumbbell 10 includes a central handle 22 selectively connected to one or more of a plurality of nested weights 24 by means of a selector pin 26. The handle 22 includes a pair of longitudinally spaced apart ends 28 interconnected by a generally centrally located grip 30 and a pair of laterally spaced apart crosstubes 32. The grip 30 is preferably coated or surrounded by a sleeve of foam material for comfort. Since the crosstubes 32 contact the wrists of the athlete during use of the dumbbell 10, they are also preferably coated or encased with a similar foam material for comfort.

If desired, the grip 30 and crosstubes 32 can be mounted for adjustability. The grip 30 is shown in a position substantially coincident with the center of gravity of the dumbbell 10, however, if desired, an alternate offset mounting position can be provided as shown in FIG. 4 in order to create some leverage so as to effectively increase the training resistance. Similarly, alternate mounting positions for the crosstubes 32 can be provided as shown for adjusting the spacing therebetween in accordance with the wrist size of the athlete, as best seen in FIG. 3.

The handle 22 fits inside a nested arrangement of weights 24. In the preferred embodiment, eight such weights 24 are provided, each weighing about ten pounds for a total of eighty pounds. Outward lips or projections 33 are provided on the ends 28 of handle 22 for contacting the innermost weight 24*a*, which is in contact with each successive weight.

Each weight 24 includes two longitudinally spaced apart end plates 34 interconnected by a pair of side rails 36. The end plates 34 are preferably generally square or rectangular with rounded edges and are of about the same size, weighing about five pounds each. The side rails 36 for each weight 24 are of the same length, but are of different relative lengths and positioned in vertically offset relationship between adjacent weights so as to form a nested stack as shown with sufficient space between adjacent side rails to receive the selector pin 26. The outer ends 28 of handle 22 are grooved as shown for receiving the sides or prongs 25 of the selector pin 26. Accordingly, insertion of the selector pin 26 beneath the side rails 36 connects that weight 24 and any captured weights above it to the handle 22 for movement therewith. In other words, the selector pin 26 serves to connect a weight 24 and the other innermost weights to the handle 22. The rest of the outermost weights 24 remain together in a stacked/nested configuration on the floor or stand 12.

Referring particularly to FIG. 4, the end plates 34 of the innermost weight 24*a* may include recesses or apertures as shown for receiving supplemental weights 38 which would be captured in position by the handle 22. This would provide some intermediate adjustment between the ten pound increments of weights 24. For example, the supplemental weights 38 could each be about 2.50 pounds. If desired, another set of supplemental weights 40 of a different size, such as about 1.25 pounds each in order to provide a total of 2.50 pounds adjustment as shown in FIGS. 1 and 2, could be provided for additional flexibility.

The end plates 34 of weights 24 are preferably angled slightly outwardly, such at about three degrees, for safety purposes to prevent disconnection from the handle 22 if pin 26 should come out while the dumbbell is inverted or overhead.

Figure 5:
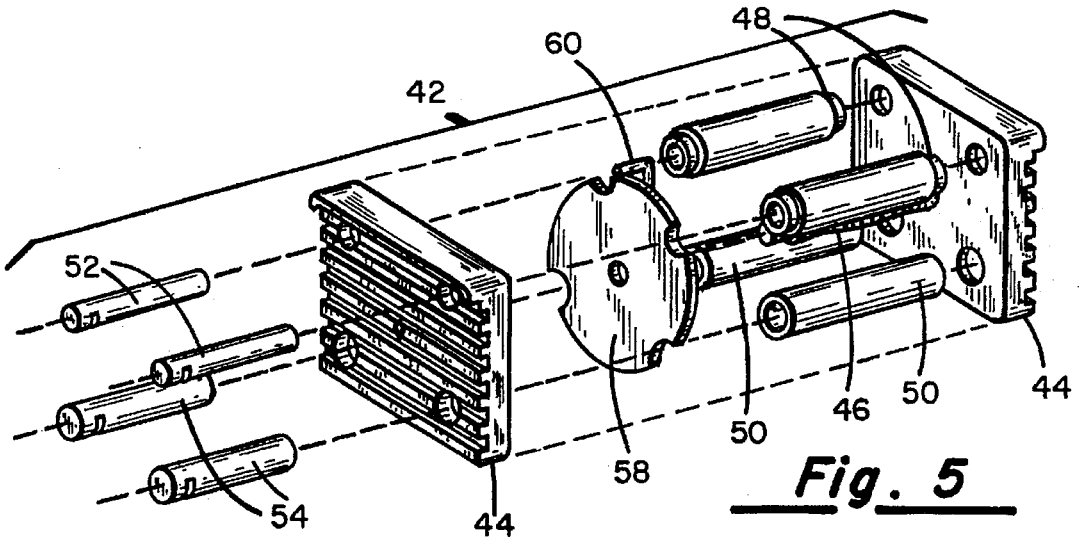
FIG. 5 is an exploded perspective view of an alternate handle construction.
Figure 6:
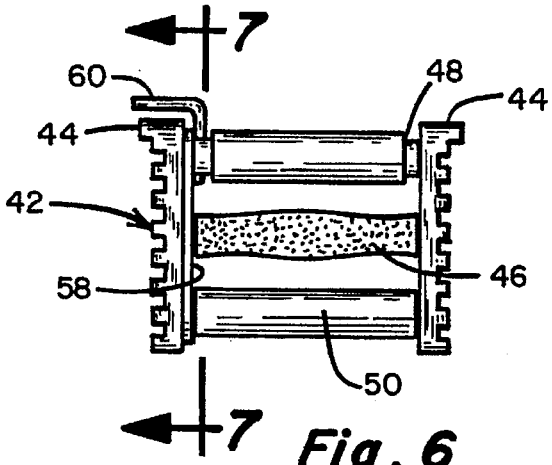
FIG. 6 is a side view thereof.
Figure 7:
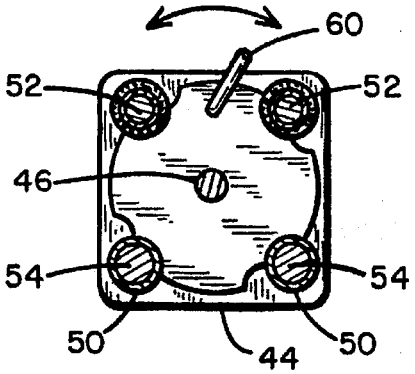
FIG. 7 is a sectional view taken along lines 7—7 of FIG. 6 in the direction of the arrows.

FIGS. 5–7 show an alternate handle 42 which provides even more flexibility in adjustment. The handle 42 includes a pair of longitudinally spaced apart ends 44 which are grooved on their outer surfaces similar to the ends 28 of handle 22. A central grip 46 similar to grip 30 is likewise secured between the ends 44. However, the handle 42 incorporates four hollow crosstubes 48 and 50 extending between the corners of the ends 44, which are closed at one end and open at the other through openings in one end for receiving cylindrical supplemental or ballast weights 52 and 54 therein. In accordance with the preferred embodiment, the crosstubes 48 and 50 are of different sizes for respectively receiving ballast weights 52 and 54 of different relative sizes. For example, each ballast weight 52 can weigh about 0.75 pound, while each ballast weight 54 can weigh about 1.25 pound. Further, each of the ballast weights 52 and 54 includes a circumferential recess or groove for receiving the periphery of a locking disc 58 which is rotatable about the grip 46 by means of lever 60 in order to secure the weights within the handle 42. As shown, the periphery of the locking disc 56 includes four cutouts which cooperate with adjacent circumferential slots in the crosstubes 48 and 50 so as to selectively secure the ballast weights 52 and 54 within the handle 42. The handle 42 can thus be used either alone or with one or more weights 24. Further, any combination of ballast weights 52 and 54, either alone or together with one or both of the others, can be used to achieve the desired degree of adjustment and leverage for most effective training.

Figure 8:
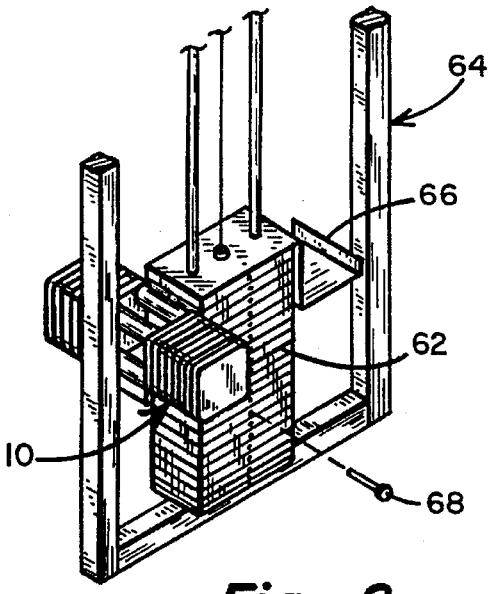
FIGS. 8 and 9 are illustrations showing the adjustable dumbbell herein utilized in conjunction with a conventional weight stack in an exercise machine.
Figure 9:
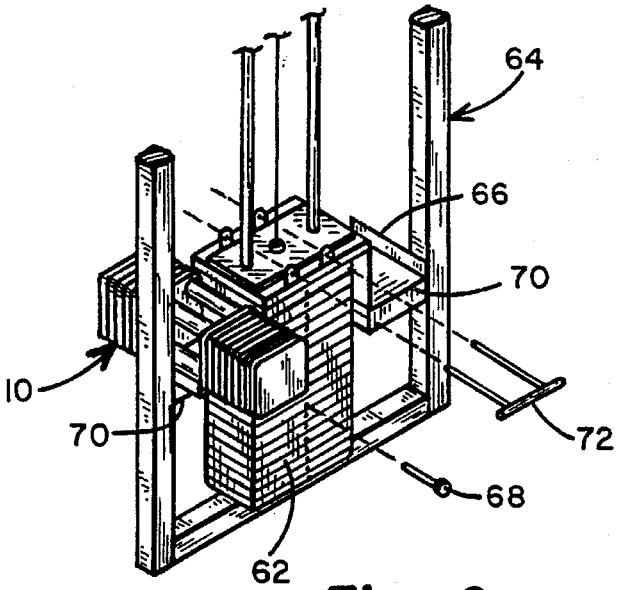

FIGS. 8 and 9 illustrate usage of the dumbbell 10 in conjunction with a conventional weight stack 62 in an exercise machine 64. In FIG. 8, the adjustable dumbbells 10, only one of which is shown, are set on a tray 66 extending over the top weight in the weight stack 62 in order to supplement whatever amount of weight is selected by means of pin 68. FIG. 9 shows a modified tray 66 which is normally supported on frame extensions 70 of the exercise machine 64, but which can be selectively connected to the top most weight in the weight stack 62 by means of pin 72 so that the exercise machine 64 can be used either with or without the supplemental weight of the adjustable dumbbells 10.

If desired, the adjustable dumbbell 10 herein could be adapted for use as a substitute, instead of a supplement to a weight stack or other resistance, in an exercise machine.

From the foregoing, it will thus be apparent that the present invention comprises an adjustable dumbbell having several advantages over the prior art. The dumbbell herein is of compact construction and is easily adjustable. The unused weights remain nested in an orderly stack in one place, rather than lying about loose. Other advantages will evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. An adjustable handheld dumbbell, which comprises:

a handle;

said handle including an opposing pair of longitudinally spaced-apart ends interconnected in fixed predetermined relationship, and a generally centrally disposed longitudinal grip secured between the ends;

a plurality of weights, each weight including an opposing pair of end plates interconnected in fixed predetermined longitudinally spaced-apart relationship;

said weights being configured to be disposed in a stacked and nested contacting arrangement, the ends of said handle being adapted for insertion into nested receipt between the end plates of the uppermost weight, with the end plates of each successive weight being spaced progressively further apart for nested receipt of the next adjacent upper weight; and a generally U-shaped pin for selectively connecting at least one of said weights to said handle for movement therewith in accordance with the desired exercise resistance, said pin including a pair of longitudinally spaced-apart laterally extending prongs adapted for receipt in a transverse direction through portions of said handle and said weights.

2. The adjustable handheld dumbbell of claim 1, wherein the end plates of each weight are of the same size and shape.

3. The adjustable handheld dumbbell of claim 1, wherein the ends of said handle and the end plates of said weights are generally rectangular.

4. The adjustable handheld dumbbell according to claim 3, wherein the ends of said handle and the end plates of said weights are generally square with rounded corners.

5. The adjustable handheld dumbbell of claim 1, wherein the ends of said handle and the end plates of said weights are tilted outwardly at a predetermined angle.

6. The adjustable handheld dumbbell according to claim 5, wherein the predetermined angle is about three degrees.

7. The adjustable handheld dumbbell of claim 1, wherein the ends of said handle include grooves for receiving the prongs of said selector pin.

8. The adjustable handheld dumbbell of claim 1, wherein the prongs of said selector pin are insertable through portions of said handle and said weights in a direction generally perpendicular to the direction in which said handle is insertable into the uppermost weight.

9. The adjustable handheld dumbbell of claim 1, further including:

a pair of laterally spaced-apart, generally parallel crosstubes secured between the ends of said handle;

generally cylindrical supplemental weights adapted for insertion into said crosstubes through corresponding openings in one end of said handle; and means for selectively securing said supplemental weights within said crosstubes in order to provide intermediate adjustment of the desired exercise resistance.

10. An adjustable handheld dumbbell, which comprises:

a handle;

said handle including a generally centrally disposed longitudinal grip and a pair of laterally spaced-apart parallel crosstubes extending between a pair of longitudinally spaced-apart ends interconnected in fixed predetermined relationship;

said crosstubes being hollow with corresponding openings in one end of said handle;

a sleeve of foam material surrounding the grip of said handle;

a plurality of weights, each weight including an opposing pair of end plates interconnected in fixed predetermined longitudinally spaced-apart relationship;

said weights being configured to be disposed in a stacked and nested contacting arrangement, the ends of said handle being adapted for insertion into nested receipt between the end plates of the uppermost weight, with the end plates of each successive weight being spaced progressively further outward for nested receipt of the next adjacent upper weight;

a generally U-shaped pin for selectively connecting at least one of said weights to said handle for movement therewith in accordance with the exercise resistance desired, said pin including a pair of longitudinally spaced-apart laterally extending prongs adapted for receipt in a transverse direction through portions of said handle and said weights;

a pair of generally cylindrical supplemental weights adapted for selective insertion through the end openings and into the crosstubes of said handle; and means mounted on said handle for selectively securing said supplemental weights within the crosstubes of said handle in order to provide intermediate adjustment of the exercise resistance desired.

* * * * *